US011002086B2

(12) United States Patent
Magnuson et al.

(10) Patent No.: US 11,002,086 B2
(45) Date of Patent: May 11, 2021

(54) PIPE HANDLER

(71) Applicant: Nabors Drilling Technologies USA, Inc., Houston, TX (US)

(72) Inventors: Christopher Magnuson, Houston, TX (US); Kent Hulick, Houston, TX (US); Keith Hager, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 5 days.

(21) Appl. No.: 16/394,323

(22) Filed: Apr. 25, 2019

(65) Prior Publication Data

US 2019/0330932 A1 Oct. 31, 2019

Related U.S. Application Data

(60) Provisional application No. 62/663,043, filed on Apr. 26, 2018.

(51) Int. Cl.
*E21B 19/06* (2006.01)
*E21B 19/16* (2006.01)

(52) U.S. Cl.
CPC ..... *E21B 19/06* (2013.01); *E21B 19/16* (2013.01)

(58) Field of Classification Search
CPC ..... E21B 31/20; E21B 19/06; E21B 19/16
See application file for complete search history.

(56) References Cited

U.S. PATENT DOCUMENTS

| | | | | |
|---|---|---|---|---|
| 3,655,071 | A | 4/1972 | Langowski et al. | |
| 4,013,178 | A | 3/1977 | Brown et al. | |
| 4,042,123 | A | 8/1977 | Sheldon et al. | |
| 4,126,348 | A | 11/1978 | Palmer | |
| 4,235,469 | A * | 11/1980 | Denny | E21B 19/07 294/86.25 |
| 4,273,372 | A * | 6/1981 | Sheshtawy | E21B 17/06 166/212 |
| 6,494,516 | B1 | 12/2002 | Bertini | |
| 6,601,649 | B2 | 8/2003 | Beato et al. | |
| 6,732,822 | B2 | 5/2004 | Slack et al. | |
| 7,392,859 | B2 | 7/2008 | Mock et al. | |
| 7,909,120 | B2 | 3/2011 | Slack | |
| 8,585,110 | B2 | 11/2013 | Belik | |
| 2002/0166698 | A1 | 11/2002 | Beato et al. | |
| 2006/0118293 | A1 | 6/2006 | Juhasz et al. | |
| 2007/0107909 | A1 | 5/2007 | Pietras | |
| 2007/0209806 | A1 | 9/2007 | Mock | |
| 2008/0210063 | A1 | 9/2008 | Slack | |

(Continued)

FOREIGN PATENT DOCUMENTS

| | | | |
|---|---|---|---|
| AU | 2008202599 | A1 | 7/2008 |
| CN | 202520252 | U | 11/2012 |

(Continued)

*Primary Examiner* — Tara Schimpf
*Assistant Examiner* — Dany E Akakpo
(74) *Attorney, Agent, or Firm* — Abel Schillinger, LLP; Enrique Abarca

(57) ABSTRACT

A pipe handler comprising a body defining an axis; a slide adapted to translate in a direction parallel with the axis; and a plurality of grippers, wherein at least one of the plurality of grippers is adapted to translate in a direction generally perpendicular to the axis upon translation of the slide and selectively contact a threaded interface of an inner surface of a tubular.

21 Claims, 5 Drawing Sheets

(56) References Cited

U.S. PATENT DOCUMENTS

| | | | | |
|---|---|---|---|---|
| 2009/0273201 | A1 | 11/2009 | Slack | |
| 2010/0096187 | A1* | 4/2010 | Storm, Jr. ..... | E21B 23/14<br>175/50 |
| 2013/0075077 | A1 | 3/2013 | Henderson et al. | |

FOREIGN PATENT DOCUMENTS

| | | | |
|---|---|---|---|
| DE | 2805205 | A1 | 8/1979 |
| EP | 285386 | A2 | 10/1998 |
| EP | 1390585 | A2 | 2/2004 |
| WO | 2002087959 | A2 | 11/2002 |
| WO | 2013102110 | A2 | 7/2013 |
| WO | 2017065603 | A1 | 4/2017 |

* cited by examiner

PIPE HANDLER

CROSS REFERENCE TO RELATED APPLICATION

The present application claims priority under 35 U.S.C. § 119(e) to U.S. Provisional Patent Application No. 62/663,043 filed Apr. 26, 2018, entitled "PIPE HANDLER," naming inventors Christopher Magnuson et al., which is assigned to the current assignee hereof and is incorporated by reference herein in its entirety.

FIELD OF THE DISCLOSURE

The present disclosure relates to pipe handlers, and more particularly to pipe handlers adapted to contact an inner surface of a tubular.

RELATED ART

Drill rigs typically utilize thin-walled tubulars connected together for construction of a drill string which is suspended above a wellbore. Tubulars can include regular sections of pipe typically having lengths of approximately 30 feet and subs which are usually shorter than the regular sections and used, for example, in crossover threading operations.

To move the tubulars, drill strings typically include a pipe handler adapted to grip an external portion of the tubular. Such pipe handlers may include two or more arms that extend around the tubular and close upon the external surface thereof. Frictional or collared engagement typically holds the tubulars relative to the pipe handler, minimizing slippage.

More recently, with the advent of new drilling equipment and processes, operators seek better ways of moving tubulars on the drill string. Some recent pipe handlers employ internal grippers which engage with an internal surface of the tubular. However, such pipe handlers are not without their limitations and faults. The drilling industry continues to demand improvements in the field of pipe handlers.

BRIEF DESCRIPTION OF THE DRAWINGS

Embodiments are illustrated by way of example and are not limited in the accompanying figures.

DETAILED DESCRIPTION

Figure 1:
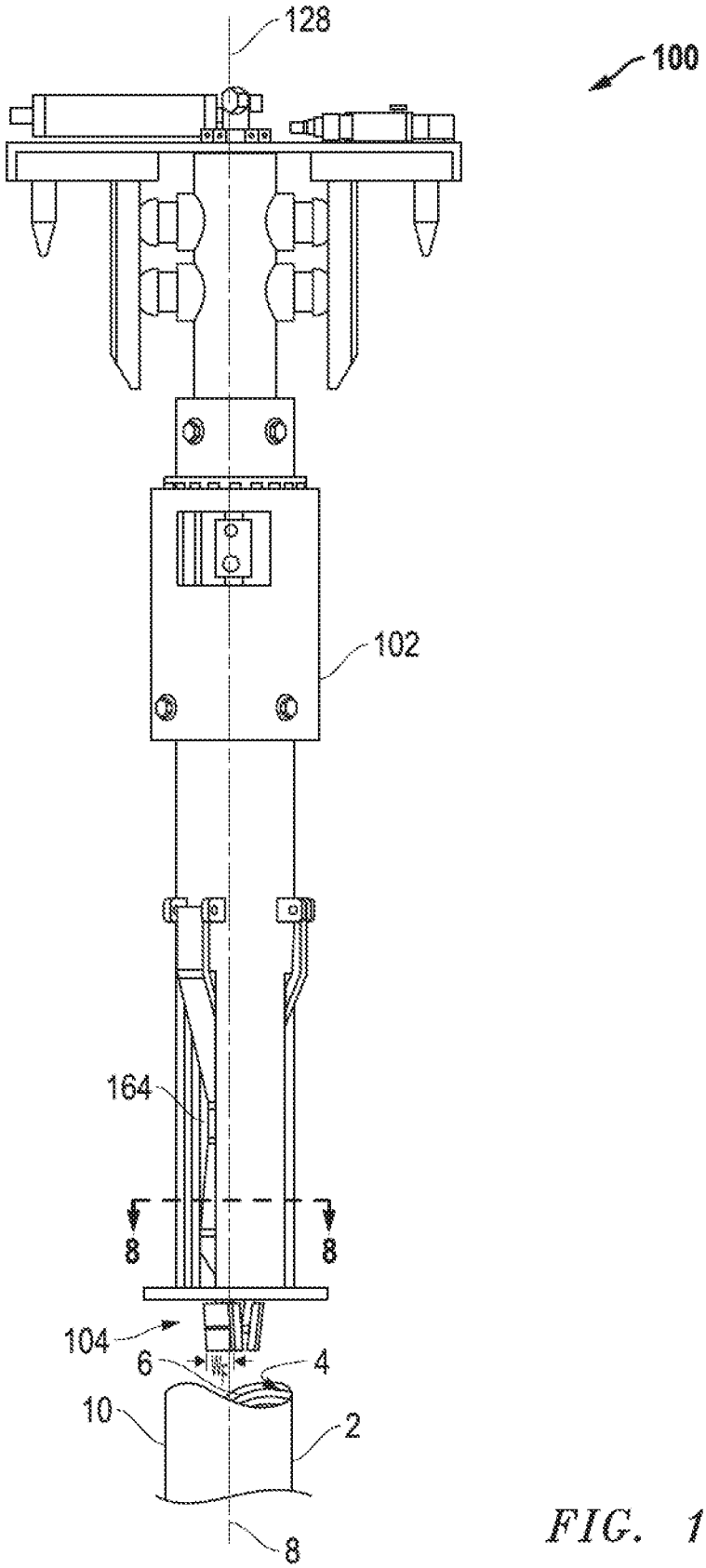
FIG. 1 includes a side view of a pipe handler in accordance with an embodiment.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the drilling arts.

A pipe handler in accordance with one or more embodiments described herein can generally include a body defining an axis, a slide adapted to translate in an axial direction generally parallel with the axis, and a plurality of grippers coupled to the body. In a particular embodiment, at least one of the plurality of grippers is adapted to translate in a radial direction generally perpendicular to the axis upon translation of the slide. In another particular embodiment, the at least one gripper is adapted to selectively move radially outward and compress against a threaded interface on an inner surface of a tubular.

In an embodiment, a method of grabbing a tubular can include inserting a pipe handler into the tubular such that a plurality of grippers of the pipe handler is disposed within an internal volume of the tubular. At least one of the plurality of grippers can be biased radially outward toward a threaded interface on an inner surface of the tubular until contacting the threaded interface of the tubular.

In an embodiment, a pipe handler can include a body defining a longitudinal axis of the pipe handler, a slide that selectively translates in a first axial direction that is parallel with the longitudinal axis and selectively translates in a second axial direction that is opposite the first axial direction, and a plurality of grippers, with at least one of the plurality of grippers that translates in a first radial direction in response to the translation of the slide in the first axial direction, with the at least one of the plurality of grippers that translates in a second radial direction in response to the translation of the slide in the second axial direction with the second radial direction being opposite the first radial direction, and with the at least one of the plurality of grippers being configured to contact a threaded interface of an inner surface of a tubular when the at least one of the plurality of grippers translates in the first radial direction.

In an embodiment, a method of grabbing a tubular that can include inserting a pipe handler into an axial end of a tubular such that a plurality of grippers of the pipe handler are disposed within an internal volume of the tubular, biasing the plurality of grippers radially outward toward a threaded interface on an inner surface of the tubular, and contacting the threaded interface of the tubular with the plurality of grippers, thereby grabbing the tubular.

The method can also include inserting the pipe handler an insertion distance into the tubular, with the insertion distance being determined by a distance between a stop element of the pipe handler and a bottom end of the plurality of grippers.

In an embodiment, a method of grabbing a tubular that can include inserting a pipe handler into an axial end of a tubular such that a plurality of grippers of the pipe handler are disposed within an internal volume of the tubular, applying a mechanical force to an engagement element of the pipe handler, translating the engagement element radially inward, thereby applying fluid pressure to a slide of the pipe handler, translating the slide in an axial direction toward the plurality of grippers in response to the applied fluid pressure, biasing the plurality of grippers radially outward toward a threaded interface on an inner surface of the tubular in response to the translating of the slide in the axial direction, and contacting the threaded interface of the tubular with the plurality of grippers, thereby grabbing the tubular.

Referring to FIG. 1, a pipe handler 100 can generally include a body 102 and at least one gripper, such as a plurality of grippers 104. The pipe handler 100 can be adapted to grip an inner surface 4 of a tubular 2 and move the tubular 2 on a drill rig (not illustrated). In a more particular embodiment, the pipe handler 100 can be adapted to grip a threaded interface 6 of the tubular 2.

In an embodiment, the pipe handler 100 is adapted to grip a regular length of tubular used as part of a drill string for a wellbore. Typical sections of tubular are 30 feet long and included threaded interfaces along inner surfaces adjacent to longitudinal ends thereof. In another embodiment, the pipe handler 100 is adapted to grip a non-regular length of tubular often referred to as a sub. Subs typically include any small component of a drill string, such as a short drill collar sub or a threaded crossover sub. Subs typically weigh less than regular sections of tubular, have lengths between 36 inches and 42 inches, and include threaded interfaces along inner surfaces adjacent to longitudinal ends thereof. Unless described otherwise, the term "tubular" is used interchangeably herein to describe regular sections of tubular and subs, however it is noted that certain embodiments of the pipe handler described herein are adapted for use with subs.

Figure 3:
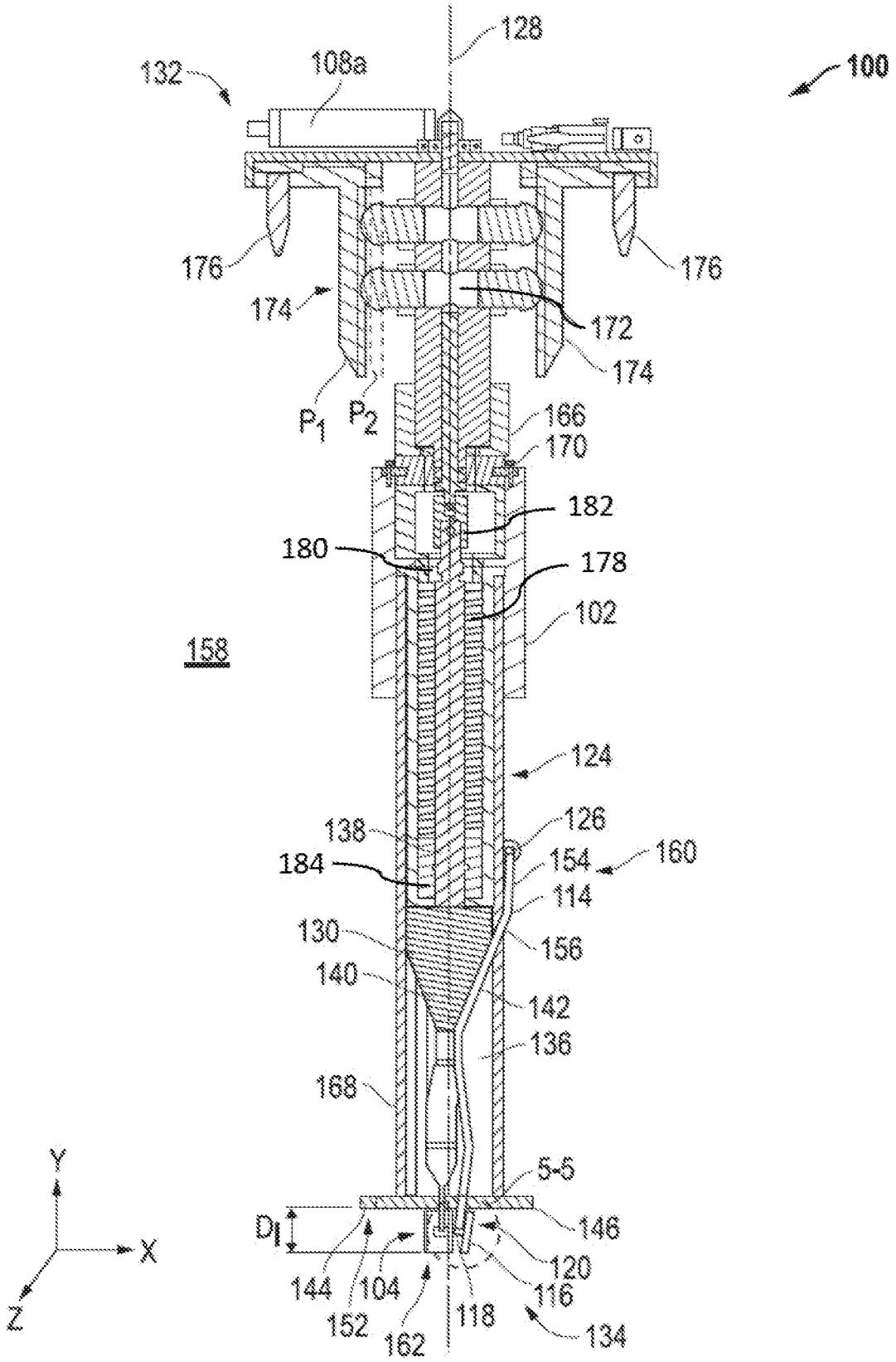
FIG. 3 includes a cross-sectional side view of a pipe handler in accordance with an embodiment as seen along Line A-A in FIG. 2.

Referring to FIG. 3, the pipe handler 100 includes a plurality of grippers 104. For example, the plurality of grippers 104 can include at least two grippers, or at least three grippers, or at least four grippers, or at least five grippers, or at least six grippers. In a particular embodiment, the plurality of grippers 104 includes no greater than ten grippers, or no greater than nine grippers, or no greater than eight grippers, or no greater than seven grippers.

In an embodiment, at least one of the plurality of grippers 104 includes an arm 114 and a gripping pad 116. In a more particular embodiment, all of the plurality of grippers can include an arm 114 and a gripping pad 116.

In an embodiment, the gripping pad 116 of the at least one gripper 104 can be dynamically coupled to the arm 114 such that the gripping pad 116 is moveable with respect to the arm 114. For example, in a particular embodiment the gripping pad 116 can be rotationally coupled to the arm 114 about a rotational axis 118. The rotational axis 118 can be perpendicular to a length of the arm 114, permitting articulation of the gripping pad 116 along an X-Y plane.

In an embodiment, the gripping pad 116 of at least one of the plurality of grippers 104 is removably coupled to the arm 114. In certain instances, a drilling operator may selectively remove the gripping pad 116 from the arm 114 to interchange with another gripping pad 116, for example to replace a worn gripping pad 116 or to select a gripping pad with a different characteristic more suitable for gripping a particular type or sized tubular.

In certain instances, the pipe handler 100 can be adapted to grip tubulars of various different diameters. In a particular embodiment, the pipe handler 100 can be adapted to grip tubulars having diameters in a range of 5 mm and 400 mm while providing the same, or generally same, pressure against the inner surface of the tubular. As used herein, "generally same pressure" refers to a deviation in pressure of no greater than 10%, or no greater than 8% or no greater than 5%, or no greater than 2% from a stated range.

In an embodiment, the gripping pad 116 of at least one of the plurality of grippers 104 can be flexible and adapted to conform to a radius of the various different diameters. As the grippers 104 contact and bias against the inner surface 4 of the tubular 2, the gripping pad 116 can deform and accept the contour of the inner surface 4. In another embodiment, the gripping pad 116 of at least one of the plurality of grippers 104 can be static (i.e., generally non-deforming). For example, in an embodiment, an outer surface 120 of the gripping pad 116 of at least one of the plurality of grippers 104 can lie along an arc that lies along a plane perpendicular to the length of the arm 114. The arc can define a radius of curvature generally equal to a radius of curvature of the tubular 2 to be gripped. A drilling operator can have a plurality of various-shaped gripping pads 116 for use with the various tubulars and select the most appropriately shaped gripping pad 116 for the tubular to be gripped.

Figure 5A:
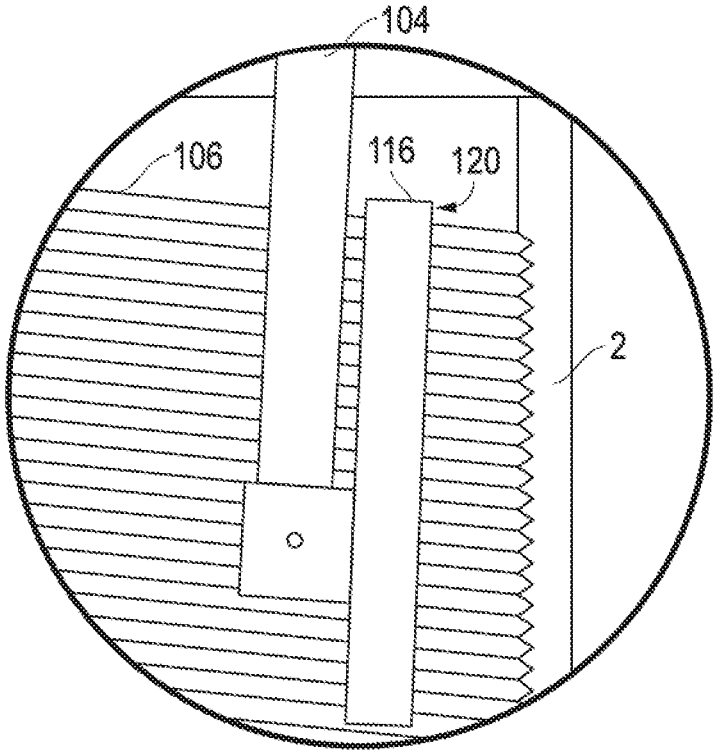
FIGS. 5A and 5B are enlarged cross-sectional side views of a pipe gripper of a pipe handler in accordance with an embodiment as seen in Circle 5-5 in FIG. 3.
Figure 5B:
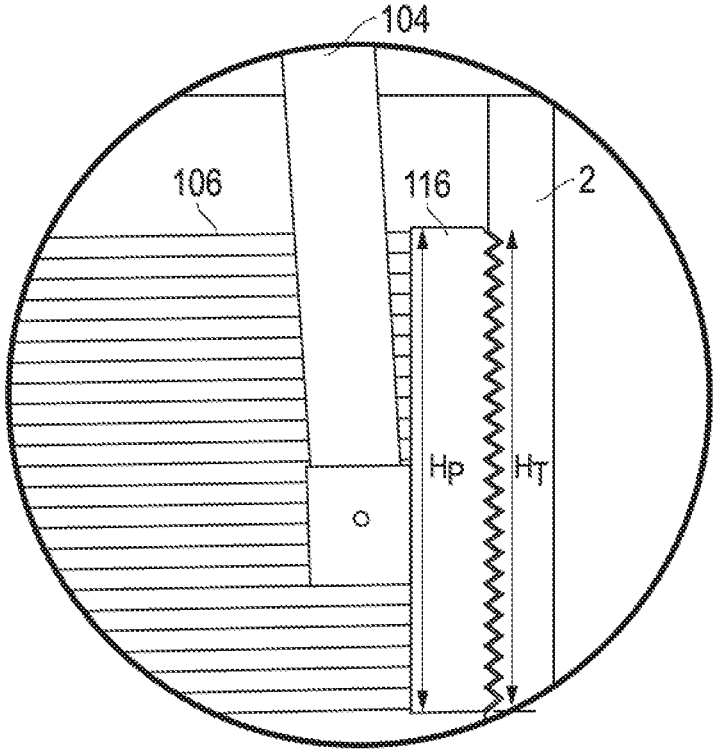

Referring to FIGS. 5A and 5B, in certain embodiments, the gripping pad 116 of at least one of the plurality of grippers 104 can include a polymeric material. In a more particular embodiment, the outer surface 120 of at least one of the gripping pads 116 can include the polymeric material. The polymeric material can be selected to have a desirable characteristic for engaging with tubulars 2. For example, in certain embodiments, the polymeric material can be deformable, or have a relatively high coefficient of friction, or both. Exemplary polymeric materials include, but are not limited to, polyethylene, polypropylene, poly(vinyl chloride), poly (vinylidene chloride), an acrylic, a condensation polymer such as polyester or nylon, neoprene, polypropylene, polystyrene, a synthetic rubber, a natural rubber, or any combination thereof. In a particular embodiment, the gripping pad 116 can further include a substrate (not illustrated) adapted to support the polymeric material.

FIG. 5A includes an embodiment of the gripping pad 116 prior to contacting the threaded interface 106 of the tubular 2. FIG. 5B includes an embodiment of the gripping pad 116 during contact with the threaded interface 106. As illustrated, at least a portion of the gripping pad 116 can deform upon contacting the threaded interface 106. In an embodiment, the outer surface 12—of the gripping pad 116 can deform to accept and occupy the contours of the threaded interface 106. The illustrated embodiment is intended as exemplary. In other embodiments, the gripping pad 116 can conform to a lesser or greater degree with respect to the contours of the threaded interface 106.

The gripping pad 116 of at least one of the plurality of grippers 104 can define a height, $H_P$, as measured by a dimension of the gripping pad 116 generally parallel with an axis 122 (FIG. 3) of the body 102, and a width, $W_P$ (FIG. 1), as measured perpendicular with the height, $H_P$. In an embodiment, $H_P$ can be no greater than 5.0 $W_P$, or no greater than 4.0 $W_P$, or no greater than 3.0 $W_P$, or no greater than 2.0 $W_P$, or no greater than 1.5 $W_P$. In another embodiment, $H_P$ is at least 0.1 $W_P$, or at least 0.5 $W_P$, or at least 1.0 $W_P$.

The threaded interface 106 of at least one of the tubulars 2 to be gripped can define a height, $H_T$, as measured parallel with an axis 8 of the tubular 2 (FIG. 1). In an embodiment, $H_P/H_T$ is in a range between and including 0.2 and 5.0, or in a range between and including 0.5 and 3.0, or in a range between and including 0.8 and 1.5. In a particular embodiment, $H_P$ can be equal, or generally equal, with $H_T$. While not required, use of a gripping pad 116 with a height, $H_P$, equal, or generally equal, to the height, $H_T$, of the threaded interface 106 can permit optimized grip of the gripping pad 116 with the tubular 2. More particularly, when $H_P$ is equal, or generally equal, with $H_T$, the gripping pad 116 may more easily conform to the shape of the threaded interface 106. In a particular embodiment, at least one of the gripping pads 116 of the plurality of grippers 104 is adapted to contact the tubular 2 only along the threaded interface 6. More particularly, the at least one gripping pad 116 can be spaced apart from non-threaded surfaces of the tubular 2.

Figure 4:
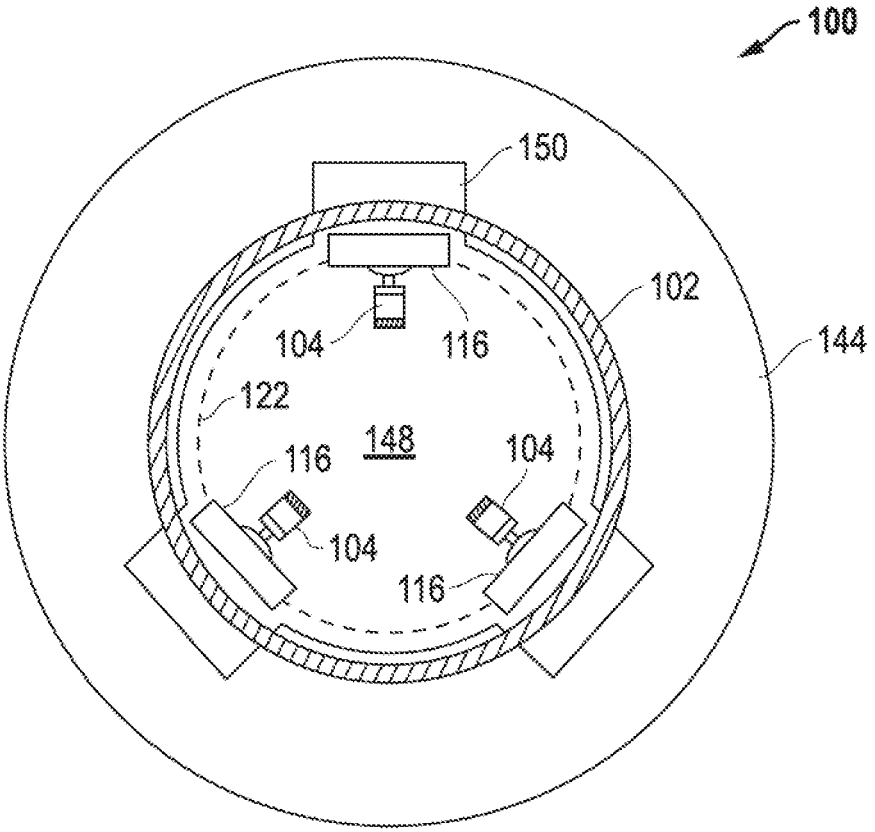
FIG. 4, includes a cross-sectional top view of a pipe handler in accordance with an embodiment as seen along line B-B in FIG. 1

Referring to FIG. 4, in an embodiment the plurality of grippers 104 can be arranged in a relative orientation generally conforming to a best fit circle 122. As illustrated, the best fit circle 122 can be defined by the gripping pads 116 of the plurality of grippers 104. In a particular embodiment, the plurality of grippers 104 are equally spaced apart from one another, as measured in a circumferential manner. In another embodiment, at least two sets of the plurality of grippers 104 can be spaced apart from one another by different relative distances (i.e., the at least two sets of grippers 104 can be non-equidistantly spaced apart from one another).

Referring again to FIG. 3, in an embodiment at least one of the plurality of grippers 104 is coupled to the pipe handler 100 along an outer surface 124 of the body 102. In a more particular embodiment, at least one of the plurality of grippers 104 is pivotally coupled to the outer surface 124 of the body 102. In a further embodiment, at least one of the plurality of grippers 104 is adapted to pivot about a pivot axis 126 oriented generally perpendicular to an axis 128 of the body 102. At least one of plurality of grippers 104 can be adapted to pivot at least 1°, or at least 2°, or at least 3°, or at least 4°, or at least 5°, or at least 10°, or at least 25°, or at least 45° along the X-Y plane. In an embodiment, the at least one gripper 104 can be adapted to pivot less than 360°, or less than 180°, or less than 90°, or less than 60° along the X-Y plane.

In an embodiment, the arm 114 of at least one of the plurality of grippers 104 can include a plurality of segments, such as a plurality of linear segments that lie along intersecting lines. For example, in an embodiment, the at least one arm 114 can include a first segment 154 and a second segment 156. In a particular embodiment, the first segment 154 of the arm 114 can be pivotally coupled to the body 102 of the pipe handler 100 and the second segment 156 of the arm 114 can be coupled to the first segment 154 at a non-linear angle (i.e., not 180°). The second segment 156 of the arm 114 can extend from an external environment 158 through an opening 164 (FIG. 1) of the body 102 into an internal volume 136 thereof.

In a particular embodiment, the arm 114 is pivotally coupled to the body 102 at a first longitudinal end 160 of the arm 114 and the gripping element 116 is disposed at a second longitudinal end 162 of the arm 114. The first and second longitudinal ends 160 and 162 can be disposed on opposite sides of the arm 114.

In an embodiment, at least one of the plurality of grippers 104 is adapted to be biased in a radially outward direction by a translating member, hereinafter referred to as a slide 130. In an embodiment, the slide 130 can translate between a first axial end 132 and a second axial end 134 of the pipe handler 100. In a more particular embodiment, the slide 130 can be adapted to translate in a direction generally parallel with the axis 128 of the body 102. As the slide 130 translates toward the second axial end 134 of the pipe handler 100 it can contact at least one of the grippers 104 and bias the at least one gripper 104 in a direction generally perpendicular to the axis 128 of the body 102. As the pipe handler 100 is transitioned from an unengaged configuration with the tubular 2 (i.e., the pipe handler 100 is not fully engaged with the tubular 2) to an engaged configuration with the tubular 2, the slide 130 can be translated along the axis 128 (or longitudinal axis 128) of the body 102 in a direction generally toward the plurality of grippers 104 at the second axial end 134 of the body 102.

As illustrated in FIG. 3, the slide 130 can be at least partially disposed in the internal volume 136 of the body 102 of the pipe handler 100. In a more particular embodiment, the slide 130 can be disposed entirely within the internal volume 136 of the body 102.

In an embodiment, the slide 130 can include a shaft 138 and a head 140. The shaft 138 can have a length extending generally parallel with the axis 128 of the body 102. The shaft can have an upper and lower portion with a coupler 182 that couples the upper and lower portions together to form the shaft 138. The shaft 138 can reciprocate up and down within the pipe handler as an actuation force is selectively applied to and removed from the engageable elements 174. A clearance 180 can be provided to allow the reciprocation of the shaft 138 within the pipe handler 100. In an embodiment, the head 140 has a tapered surface 142 disposed at a relative angle with respect to the axis 128. The head 140 can be biased away from the plurality of grippers 104 by a biasing device 178 (e.g. spring). When a force applied to the slide 130 that translated the head 140 downward toward the plurality of grippers 104 is removed, the biasing device can urge the head 140 away from the plurality of grippers 104, thereby disengaging the plurality of grippers 104 from the internal threaded area of the tubular.

In an embodiment, the tapered surface 142 is angularly offset from the axis 128 by at least 1°, or at least 2°, or at least 3°, or at least 4°, or at least 5°, or at least 10°, or at least 15°, or at least 20°, or at least 25°, or at least 30°, or at least 35°. In another embodiment, the tapered surface 142 is angularly offset form the axis 128 by no greater than 90°, or no greater than 85°, or no greater than 80°, or no greater than 75°, or no greater than 70°, or no greater than 65°. In an embodiment, the tapered surface 142 can have a uniform taper as measured around the circumference of the slide 130. In another embodiment, the tapered surface 142 can have a varying taper as measured around the circumference of the slide 130.

In operation grabbing a tubular 2, the tapered surface 142 of the slide 130 can be adapted to bias at least one of the plurality of grippers 104 in a radially outward direction when the slide 130 is translated in a direction generally parallel with the axis 128.

Figure 2:
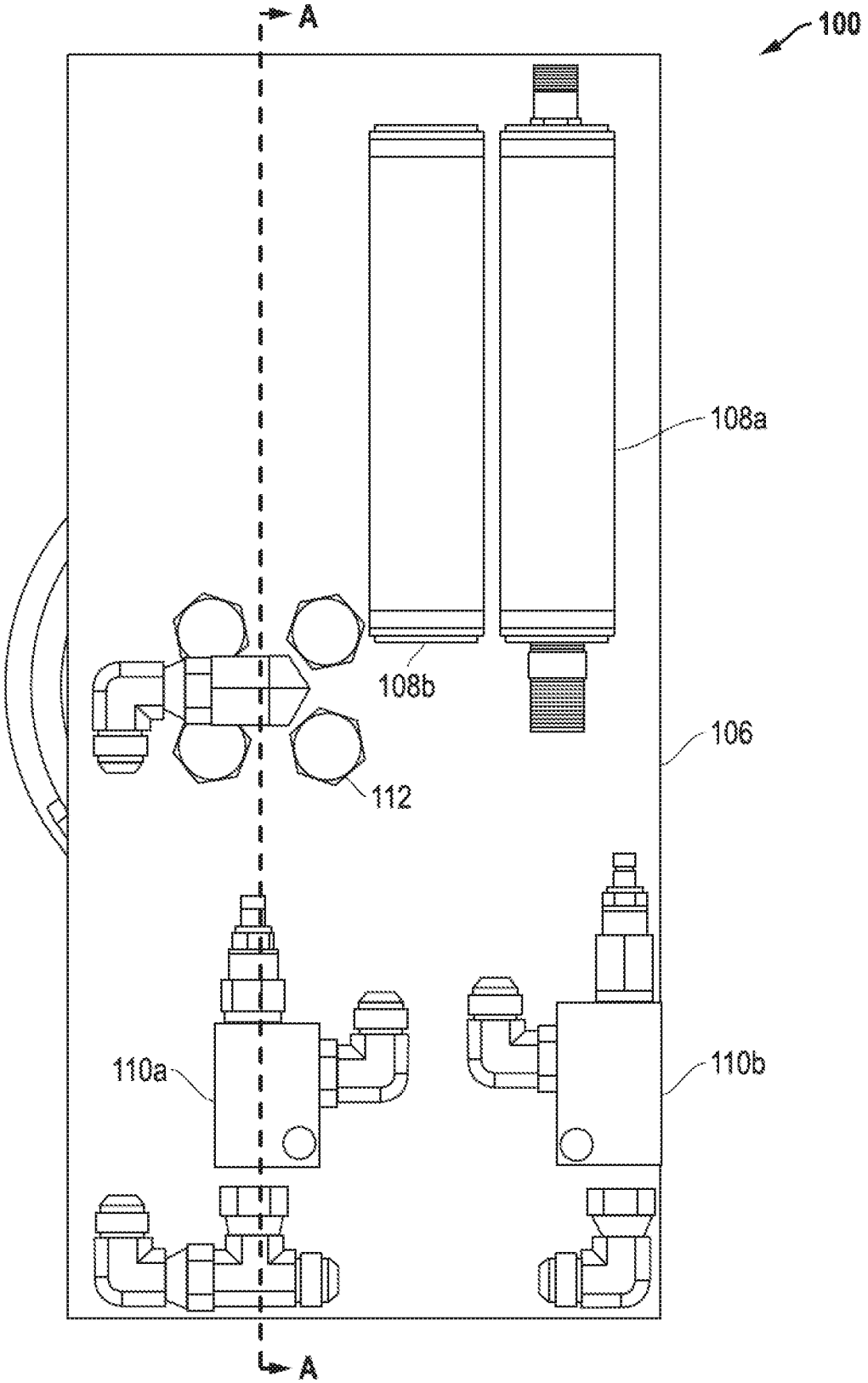
FIG. 2 includes a top view of a pipe handler in accordance with an embodiment.

FIG. 2 illustrates a top view of the pipe handler 100. The body 102 of the pipe handler can be supported from a support structure 106. In an embodiment, the support structure 106 can include a pressure control system. In a particular embodiment, the pressure control system can include an overflow element 108*a* and a back pressure element 108*b*. At least one of the overflow element 108*a* and back pressure element 108*b* can include an accumulator adapted to receive fluid from an actuation volume 172 discussed in greater detail below. The accumulator can include, for example, a bladder type pressure control system or a spring-biased system.

In an embodiment, the overflow element 108*a* and back pressure element 108*b* can be adapted to operate in parallel. A fluid passageway can extend from each of the overflow element 108*a* and back pressure element 108*b* to the actuation volume 172 or an intermediary element disposed in communication therewith.

In an embodiment, the back pressure element 108*b* is adapted to operate at a first pressure and the overflow element 108*a* is adapted to operate at a second pressure different from the first pressure. In a particular embodiment, the first pressure is greater than the second pressure. For example, the back pressure element 108*b* can be adapted to operate at a pressure at least 110% the pressure of the overflow element 108*a*, or at least 120% the pressure of the overflow element 108*a*, or even at least 130% the pressure of the overflow element. In a particular instance, the overflow element 108*a* can be adapted to accommodate fluid from the actuation volume 172 (or any intermediary fluid in fluid communication therewith) for accommodating tubulars of varying size while the back pressure element 108*b* can maintain pressure of the plurality of grippers 104 against the tubular 2.

In an embodiment, the pipe handler 100 comprises a self-contained system adapted to operate without external input of hydraulic fluid or external electrical connection. That is, for example, the pipe handler 100 can be brought to a drill rig, unpacked, and utilized without requiring coupling with hoses, electrical cables, wired communication lines, or other support lines or features. In a more particular embodiment, the pipe handler 100 can be adapted to operate with application of only mechanical forces on the pipe handler 100 or parts thereof. The pipe handler 100 can be seen as being void of any connections to electrical or hydraulic sources external to the pipe handler 100. The back pressure element 108*a* and overflow element 108*b* are not sources external to the pipe handler. These are internal to the pipe handler 100.

For example, in an embodiment, the pipe handler 100 can include at least one engageable element 174 adapted to move between a first position $P_1$ and a second position $P_2$. In a particular embodiment, the engageable element 174 is adapted to move between the first position $P_1$ and second position $P_2$ by translating in a direction generally perpendicular to the axis 128 of the body 102. In general, the engageable element 174 can be moved (or translated) in a radial direction between the first position $P_1$ and the second position $P_2$. by application of a mechanical force from another piece of equipment on the rig, for example a pipe clamp on an elevator, top drive, or any rig equipment that can apply a clamping force to the engagement elements 174. The pipe clamp can be used to engage the engageable elements 174 and "squeeze" (i.e. apply a clamping or compressive force to) the elements 174 toward each other in an inwardly radial direction, thereby increasing pressure in an actuation volume 172 and actuating the plurality of grippers 104 into contact with an internal threaded area of the tubular. When the pipe clamp "releases" (i.e. removes the clamping or compressive force) the elements 174 can move away from each other in an outwardly radial direction, thereby decreasing pressure in the actuation volume 172 and actuating the plurality of grippers 104 away from contact with the internal threaded area of the tubular. The plurality of grippers 104 can be unengaged from the inner surface of the tubular when the engageable element 174 is at the first position $P_1$ and engaged with the inner surface of the tubular when the engageable element 174 is at the second position $P_2$. In an embodiment, the location of $P_2$ can be the same regardless of the inner diameter of the tubular being gripped. In a particular embodiment, the overflow element 108*a* (FIG. 2) is adapted (e.g. selecting check valves with desired pressure setting) to permit accommodation of different inner diameter tubulars while permitting a similar contact pressure with the inner surface of the different tubulars. In another embodiment, the location of $P_2$ can be different for tubulars of different inner diameters.

In an embodiment, the actuation volume 172 contains or is adapted to contain a fluid, such as a relatively incompressible fluid (e.g., hydraulic fluid). The actuation volume 172 can be in communication with the engageable element 174 directly or indirectly. In an embodiment pressure generated on the engageable element 174 by the equipment on the drill rig can bias the fluid in the actuation volume 172, causing the slide 130 to translate in a direction away from the actuation volume 172. More particularly, as previously described, the slide 130 can be biased in a direction generally parallel with the axis 128 in a direction toward the plurality of grippers 104.

In an embodiment, the actuation volume 172, or at least a portion thereof, is disposed at a same vertical elevation as the engageable element 174, or at least a portion thereof.

In an embodiment, a guide 176 can be disposed on the pipe handler 100 and adapted to guide an actuating element (e.g. any equipment used on the rig that can apply a clamping force to the engagement elements 174) to the engageable element 174. The guide can include, for example, a pin or other feature which secures with the equipment or a portion thereof, permitting the equipment to securely bias the engageable element 174.

In an embodiment, the pipe handler 100 can further include a stop element 144 adapted to contact a longitudinal end 10 of the tubular 2 prior to overinsertion of the plurality of grippers 104 therein. The stop element 144 can define a diameter, $D_{SE}$, greater than an internal diameter, $ID_T$, of the tubular 2. In an embodiment, the stop element 144 includes a generally planar body 146 disposed at or adjacent to the second axial end 134 of the body 102 of the pipe handler 100.

Referring to FIG. 4, the stop element 144 can define an aperture 148 extending through the body 146 thereof. In an embodiment, at least one of the plurality of grippers 104 can extend through the central aperture 148 of the stop element 144. In a particular embodiment, the aperture 148 can include a centrally located aperture 148. At least one cutout 150 can extend radially outward from the aperture 148. In an embodiment, the at least one cutout 150 can have a generally rectangular profile as viewed along the axis 128 of the body 102. In an embodiment, the number of cutouts 150 can be equal to the number of grippers 104 extending through the aperture 148. At least one of the cutouts 150 can be adapted to receive at least one of the plurality of grippers 104 when the at least one gripper 104 contacts the tubular 2. In an embodiment, during periods when the pipe handler 100 is not engaged with tubular 2, at least one of the grippers 104 can be spaced apart from the cutout 150.

Referring again to FIG. 3, at least a portion of at least one of the plurality of grippers 104 can extend an insertion distance, $D_I$, beyond the stop element 144. The insertion distance, $D_I$, can generally correspond with a maximum distance between the longitudinal end 10 of the tubular 2 and a furthest distance to the nearest threaded interface 6 thereof. In a particular embodiment, the stop element 144 can prevent overinsertion of the plurality of grippers 104 into the tubular 2. That is, prior to overinsertion, the longitudinal end 10 of the tubular contacts a surface 152 of the stop element 144. In certain instances, the drilling operator can use the stop element 144 as a positive stopping location before engaging the plurality of grippers 104 against the inner surface 4 of the tubular 2.

In an embodiment, the gripping pad 116 of at least one of the plurality of grippers 104 is visible when viewed perpendicular to the axis 128 of the body 102 of the pipe handler 100. In a more particular embodiment, a nearest portion of the gripping pad 116 is spaced apart from the stop element 144.

In an embodiment, the body 102 can include a multi-piece construction. For example, the body 102 can include a first portion 166 and a second portion 168 coupled together by a bearing 170 or other similar rotatable interface. In a particular embodiment, the first portion 166 of the body 102 is rotatable with respect to the second portion 168 thereof about the axis 128 of the body 102. In an embodiment, the second portion 168 of the body is adapted to be disposed at a vertical elevation below the first portion 166 of the body 102 when the pipe handler 100 is gripping the tubular 2. In a particular embodiment, all of the plurality of grippers 104 can be coupled to the second portion 168 of the body 102.

Pipe handlers in accordance with one or more of the embodiments described herein can be effective at gripping and moving tubulars on a drill rig. To operate the pipe handler 100, a drilling operator can insert the pipe handler 100, or a portion thereof, into a tubular such that the plurality of grippers 104 are disposed at least partially within the internal volume 136 of the tubular. In an embodiment, the drilling operator can continue to insert the pipe handler 100 into the tubular until an insertion distance is reached where the stop element 144 contacts a longitudinal end of the tubular. The drilling operator can bias at least one of the plurality of grippers 104 in a radially outward direction toward a threaded interface on an inner surface of the tubular, contacting the plurality of grippers 104 with the threaded interface. In an embodiment, the drilling operator can continue biasing at least one of the plurality of grippers past initial contact until the gripping pad 116 of at least one of the plurality of grippers 104 is securely engaged with the threaded interface of the tubular. With the tubular gripped, the drilling operator can then move the pipe handler and tubular relative to the drill rig (e.g., toward a drill string). After moving the tubular to the desired location, the operator can move at least one of the plurality of grippers away from the threaded interface. For example, the operator can disengage at least one of the plurality of grippers in a radially inward direction until the gripping pad of the at least one gripper is spaced apart from the threaded interface. The pipe handler can then be removed from the tubular by translating the pipe handler away therefrom. This operation can be repeated as necessary for adding or removing tubulars from the drill string. Further, this operation can be utilized in moving tubulars to and from locations other than the drill string.

In an embodiment, any operation described that might be performed by a drilling operator is performed at least semi-autonomously. For example, the pipe handler 100 or nearby equipment can include one or more detectors, such as sensors, adapted to determine a relative position of the tubular, the pipe handler, or both. The detectors can communicate with a logic element, such as a computer with a microprocessor, the detected condition. The computer can determine an action (e.g., expand or collapse at least one of the plurality of grippers) in response to the detected condition. In such a manner, the pipe handler 100 can operate without human interaction.

Embodiment 1

A pipe handler comprising a body defining an axis; a slide adapted to translate in a direction parallel with the axis; and a plurality of grippers, wherein at least one of the plurality of grippers is adapted to translate in a direction generally perpendicular to the axis upon translation of the slide and selectively contact a threaded interface of an inner surface of a tubular.

Embodiment 2

A pipe handler comprising a plurality of grippers, wherein at least one of the plurality of grippers is adapted to contact an inner surface of a tubular, wherein the pipe handler comprises a first axial end and a second axial end, and wherein the second axial end of the pipe handler is defined by at least one of the plurality of grippers.

Embodiment 3

A pipe handler comprising a plurality of grippers, wherein at least one of the plurality of grippers is adapted to grip an inner surface of a tubular, and wherein at least one of the plurality of grippers comprises a polymer surface.

Embodiment 4

A pipe handler comprising a plurality of grippers adapted to contact an inner surface of a tubular, wherein the pipe handler is self-contained.

Embodiment 5

A method of grabbing a tubular comprising inserting a pipe handler into a tubular such that a plurality of grippers of the pipe handler are disposed within an internal volume of the tubular; biasing at least one of the plurality of grippers radially outward toward a threaded interface on an inner surface of the tubular; and contacting the plurality of grippers with the threaded interface of the tubular.

Embodiment 6

The method of embodiment 5, wherein inserting the pipe handler into the tubular is performed until an insertion distance is reached, and wherein the insertion distance is determined by a distance between a stop element of the pipe handler and an axial end of the tubular.

Embodiment 7

The method of any one of embodiments 5-6, further comprising with the tubular gripped, moving the pipe handler toward a drill string, after moving the tubular to a desired location, moving at least one of the plurality of grippers away from the threaded interface; and removing the pipe handler from the tubular.

Embodiment 8

The method of any one of embodiments 5-7, wherein biasing at least one of the plurality of grippers radially outward is performed by biasing a slide along an axis of a body of the pipe handler, and wherein the biasing at least one of the plurality of grippers is adapted to move the at least one gripper in a direction generally perpendicular to the axis of the body.

Embodiment 9

The pipe handler or method of any one of the preceding embodiments, wherein the plurality of grippers comprises at least two grippers, or at least three grippers, or at least four grippers, or at least five grippers, or at least six grippers.

Embodiment 10

The pipe handler or method of any one of the preceding embodiments, wherein the plurality of grippers comprises no greater than ten grippers, or no greater than nine grippers, or no greater than eight grippers, or no greater than seven grippers.

Embodiment 11

The pipe handler or method of any one of the preceding embodiments, wherein the plurality of grippers are equally spaced apart from one another.

Embodiment 12

The pipe handler or method of any one of the preceding embodiments, wherein the plurality of grippers are coupled to a body of the pipe handler, and wherein at least one of the plurality of grippers is adapted to pivot about a pivot axis generally perpendicular to an axis of the body.

Embodiment 13

The pipe handler or method of any one of the preceding embodiments, wherein at least one of the plurality of grippers comprises an arm; and a gripping pad dynamically coupled to the arm.

Embodiment 14

The pipe handler or method of embodiment 13, wherein the gripping pad is rotationally coupled to the arm, and wherein the gripping pad is rotatable about a rotational axis perpendicular to a length of the arm.

Embodiment 15

The pipe handler or method of any one of embodiments 13 and 14, wherein the gripping pad comprises a polymer surface, and wherein the polymer surface comprises a rubber.

Embodiment 16

The pipe handler or method of any one of embodiments 13-15, wherein the gripping pad defines a height, $H_P$, and a width, $W_P$, and wherein $H_P$ is no greater than 5.0 $W_P$, or no greater than 4.0 $W_P$, or no greater than 3.0 $W_P$, or no greater than 2.0 $W_P$, or no greater than 1.5 $W_P$.

Embodiment 17

The pipe handler or method of any one of embodiments 13-16, wherein the gripping pad defines a height, $H_P$, wherein the threaded interface of the tubular to be gripped has a height, $H_T$, as measured parallel with an axis of the tubular, and wherein $H_P/H_T$ is in a range between and including 0.2 and 5.0, or in a range between and including 0.5 and 3.0, or in a range between and including 0.8 and 1.5.

Embodiment 18

The pipe handler or method of any one of embodiments 13-17, wherein an outer surface of the gripping pad lies along an arc, and wherein the arc lies along a plane perpendicular to a length of the arm.

Embodiment 19

The pipe handler or method of embodiment 18, wherein the arc is defined by a radius of curvature, and wherein the radius of curvature is generally equal to a radius of the tubular to be gripped.

Embodiment 20

The pipe handler or method of any one of embodiments 13-19, wherein the gripping pad is removably coupled to the arm.

Embodiment 21

The pipe handler or method of any one of embodiments 13-20, wherein the arm comprises a plurality of linear segments, and wherein at least two of the linear segments lie along intersecting lines.

Embodiment 22

The pipe handler or method of any one of embodiments 13-21, wherein the arm comprises a first segment pivotally coupled to a body of the pipe handler and a second segment coupled to the first segment at an angle and extending into an internal volume of the body.

Embodiment 23

The pipe handler or method of any one of embodiments 13-22, wherein the arm is pivotally coupled to a body of the pipe handler, and wherein the pivotal coupling between the body and the arm is disposed adjacent to a first longitudinal end of the arm and the gripping pad is disposed adjacent to a second longitudinal end of the arm.

Embodiment 24

The pipe handler or method of any one of embodiments 13-23, wherein the arm is pivotally coupled to the body along an outer surface of the body.

Embodiment 25

The pipe handler or method of embodiment 24, wherein the arm extends through an opening in the body to an internal volume of the body.

Embodiment 26

The pipe handler or method of any one of the preceding embodiments, wherein the pipe handler further comprises a stop element adapted to contact a longitudinal end of the tubular.

Embodiment 27

The pipe handler or method of embodiment 26, wherein the stop element comprises a generally planar body.

Embodiment 28

The pipe handler or method of any one of embodiments 26 and 27, wherein the stop element is disposed at an axial end of a body of the pipe handler.

Embodiment 29

The pipe handler or method of any one of embodiments 26-28, wherein the stop element defines a central aperture, and wherein at least one of the plurality of grippers extends through the central aperture of the stop element.

Embodiment 30

The pipe handler or method of embodiment 29, wherein the stop element further comprises at least one cutout extending radially outward from the central aperture, and wherein the at least one cutout is adapted to receive at least one of the plurality of grippers when the at least one gripper contacts the tubular.

Embodiment 31

The pipe handler or method of any one of embodiments 27-30, wherein at least a portion of at least one of the grippers extends an insertion distance beyond the stop element.

Embodiment 32

The pipe handler or method of any one of the preceding embodiments, wherein at least one of the plurality of grippers comprises a gripping pad, and wherein the entire gripping pad of the at least one gripper is visible when viewed perpendicular to a central axis of the pipe gripper.

Embodiment 33

The pipe handler or method of any one of the preceding embodiments, wherein the pipe handler comprises a body defining an axis, and wherein the body comprises a first portion and a second portion rotatable with respect to the first portion about the axis.

Embodiment 34

The pipe handler or method of embodiment 33, wherein all of the plurality of grippers are coupled to the second portion of the body, and wherein the second portion of the body is adapted to be disposed below the first portion of the body when the pipe handler is gripping the tubular.

Embodiment 35

The pipe handler or method of any one of the preceding embodiments, wherein the pipe handler further comprises a slide, and wherein the slide is adapted to translate in a direction generally parallel with an axis of a body of the pipe handler.

Embodiment 36

The pipe handler or method of embodiment 35, wherein the slide is at least partially disposed in an internal volume of the body.

Embodiment 37

The pipe handler or method of any one of embodiments 35 and 36, wherein the slide comprises a head having a tapered surface, and wherein the tapered surface of the head is adapted to bias at least one of the plurality of grippers in a radially outward direction when the slide is translated along the axis.

Embodiment 38

The pipe handler or method of any one of embodiments 35-37, wherein, when the pipe handler is transitioned from an unengaged configuration with the tubular to an engaged configuration with the tubular, the slide is biased along the axis of the body in a direction generally toward the plurality of grippers.

Embodiment 39

The pipe handler or method of any one of embodiments 35-38, wherein the plurality of grippers define a first best fit circle generally perpendicular with the axis of the body when the slide is in a first position and a second best fit circle generally perpendicular with the axis of the body when the slide is in a second position, wherein the first position corresponds with an unengaged configuration with the tubular and the second position corresponds with an engaged configuration with the tubular, and wherein the first best fit circle has a diameter less than a diameter of the second best fit circle.

Embodiment 40

The pipe handler or method of any one of the preceding embodiments, wherein the pipe handler is adapted to grip a sub.

Embodiment 41

The pipe handler or method of any one of the preceding embodiments, wherein at least one of the plurality of grippers is adapted to contact a threaded interface of an inner surface of the tubular.

Embodiment 42

The pipe handler or method of embodiment 41, wherein at least one of the plurality of grippers is adapted to contact the tubular only along the threaded interface.

Embodiment 43

The pipe handler or method of any one of embodiments 41 and 42, wherein at least one of the plurality of grippers is adapted to deform upon contacting the threaded interface.

Embodiment 44

The pipe handler or method of any one of the preceding embodiments, wherein the pipe handler is coupled with an equipment on a drill rig adapted to move the pipe handler, and wherein the pipe handler is operated by a drill operator.

Embodiment 45

The pipe handler or method of any one of the preceding embodiments, wherein the pipe handler comprises a self-contained system adapted to operate without input of an external hydraulic fluid or external electrical connection.

Embodiment 46

The pipe handler or method of any one of the preceding embodiments, wherein the pipe handler comprises at least one engageable element adapted to be operable between an unengaged configuration and an engaged configuration by moving the at least one engageable element from a first position to a second position, and wherein moving the engageable element to the engaged configuration causes the plurality of grippers to contact an inner surface of the tubular.

Embodiment 47

The pipe handler or method of embodiment 46, wherein the at least one engageable element is adapted to move between the first and second positions by translating in a direction generally perpendicular to the axis of the body.

Embodiment 48

The pipe handler or method of embodiment 47, wherein at least one of the plurality of grippers is unengaged from the inner surface of the tubular when the at least one engageable element is in the first position, and wherein the at least one gripper is engaged with the inner surface of the tubular when the at least one engageable element is in the second position.

Embodiment 49

The pipe handler or method of any one of embodiments 46-48, wherein the at least one engageable element is adapted to be biased from the first position to the second position by an equipment disposed on the drill rig.

Embodiment 50

The pipe handler or method of embodiment 49, wherein the pipe handler further comprises a guide adapted to guide the equipment to the at least one engageable element.

Embodiment 51

The pipe handler or method of any one of embodiments 46-50, wherein the pipe handler further comprises an actuation volume containing a fluid, and wherein the at least one engageable element is adapted to bias the fluid.

Embodiment 52

The pipe handler or method of embodiment 51, wherein the actuation volume is disposed within the body of the pipe handler, wherein at least a portion of the actuation volume is disposed at a same vertical elevation as the at least one engageable element, or wherein Embodiment 53

The pipe handler or method of any one of embodiments 51 and 52, wherein the actuation volume is in fluid communication with the slide and the engageable element, and wherein force applied on the actuation volume by the engageable element is adapted to bias the slide.

Embodiment 54

The pipe handler or method of any one of the preceding embodiments, wherein the pipe handler is adapted to grip tubulars having diameters in a range of 5 mm and 400 mm, and wherein the pipe handler is adapted to provide a same pressure against the inner surfaces of the tubulars.

Embodiment 55

The pipe handler or method of any one of the preceding embodiments, wherein the pipe handler further comprises a pressure control system comprising an overflow element and a back pressure element.

Embodiment 56

The pipe handler or method of embodiment 55, wherein the overflow element and back pressure element are adapted to operate in parallel.

Embodiment 57

The pipe handler or method of any one of embodiments 55 and 56, wherein at least one of the overflow element and back pressure element comprises an accumulator.

Embodiment 58

The pipe handler or method of any one of embodiments 55-57, wherein the back pressure element is adapted to operate at a first pressure, wherein the overflow element is adapted to operate at a second pressure, and wherein the first pressure is greater than the second pressure Embodiment 59

A pipe handler comprising a body defining an axis; a slide that selectively translates in a first axial direction that is parallel with the axis and selectively translates in a second axial direction that is opposite the first axial direction; and a plurality of grippers, wherein at least one of the plurality of grippers translates in a first radial direction in response to the translation of the slide in the first axial direction, wherein the at least one of the plurality of grippers translates in a second radial direction in response to the translation of the slide in the second axial direction with the second radial direction being opposite the first radial direction, and wherein the at least one of the plurality of grippers is configured to contact a threaded interface of an inner surface of a tubular when the at least one of the plurality of grippers translates in the first radial direction.

Embodiment 60

The pipe handler of embodiment 59, wherein each one of the plurality of grippers comprises a polymer surface, and wherein the polymer surface is configured to deform when contacting the threaded interface.

Embodiment 61

The pipe handler of embodiment 59, further comprising a stop element that is configured to engage an axial end of the tubular, wherein the stop element ensures the plurality of grippers are inserted into the tubular a pre-determined insertion distance when the axial end of the tubular is engaged with the stop element.

Embodiment 62

The pipe handler of embodiment 61, wherein the stop element comprises a generally planar body, and wherein the stop element is disposed at an axial end of the pipe handler.

Embodiment 63

The pipe handler of embodiment 62, wherein the stop element defines a central aperture, and wherein the plurality of grippers extend through the central aperture of the stop element.

Embodiment 64

The pipe handler of embodiment 63, wherein the stop element further comprises at least one cutout extending radially outward from the central aperture, and wherein the at least one cutout is adapted to receive the at least one of the plurality of grippers when the at least one of the plurality of grippers contacts the tubular.

Embodiment 65

The pipe handler of embodiment 59, wherein the plurality of grippers are equally spaced apart around a circumference of the pipe handler.

Embodiment 66

The pipe handler of embodiment 62, wherein the plurality of grippers are rotationally coupled to the body of the pipe handler, and wherein each one of the plurality of grippers is adapted to pivot about a pivot axis generally perpendicular to the axis of the body.

Embodiment 67

The pipe handler of embodiment 59, wherein each one of the plurality of grippers comprises: an arm; and a gripping pad that is rotationally coupled to the arm.

Embodiment 68

The pipe handler of embodiment 67, wherein the arm comprises a first segment pivotally coupled to the body of the pipe handler, and a second segment coupled to the first segment at an angle and extending into an internal volume of the body.

Embodiment 69

The pipe handler of embodiment 59, wherein the body comprises a first portion and a second portion, with the second portion being rotatably coupled to the first portion such that the second portion rotates about the axis of the body with respect to the first portion, wherein the second portion being disposed below the first portion, and wherein the plurality of grippers are coupled to the second portion of the body.

Embodiment 70

The pipe handler of embodiment 69, wherein the slide is at least partially disposed in an internal volume of the body, wherein the slide comprises a head having a tapered surface, and wherein the tapered surface biases the at least one of the plurality of grippers in the first radial direction when the slide is translated in the first axial direction, with the first axial direction being toward the tubular.

Embodiment 71

The pipe handler of embodiment 70, wherein the pipe handler is transitioned from an unengaged configuration with the tubular to an engaged configuration with the tubular, when the slide is translated in the first axial direction, and wherein the pipe handler is transitioned from the engaged configuration with the tubular to the disengaged configuration with the tubular, when the slide is translated in the second axial direction Embodiment 72

A method of grabbing a tubular comprising inserting a pipe handler into an axial end of a tubular such that a plurality of grippers of the pipe handler are disposed within an internal volume of the tubular; biasing the plurality of grippers radially outward toward a threaded interface on an inner surface of the tubular; and contacting the threaded interface of the tubular with the plurality of grippers, thereby grabbing the tubular.

Embodiment 73

The method of embodiment 72, wherein inserting the pipe handler comprises inserting the pipe handler an insertion distance into the tubular, and wherein the insertion distance is determined by a distance between a stop element of the pipe handler and a bottom end of the plurality of grippers.

Embodiment 74

The method of embodiment 72, further comprising with the tubular grabbed, moving the pipe handler toward a drill string; after moving the tubular to a desired location, biasing of the plurality of grippers away from the threaded interface; and removing the pipe handler from the tubular.

Embodiment 75

The method of embodiment 72, wherein biasing the plurality of grippers further comprises applying fluid pressure to a slide that is at least partially contained within an internal volume of the pipe handler; translating the slide in an axial direction toward the plurality of grippers in response to the applying the fluid pressure; and biasing the plurality of grippers radially outward toward a threaded interface in response to the translating of the slide in the axial direction.

Embodiment 76

The method of embodiment 75, wherein applying the fluid pressure further comprises engaging at least one engagement element of the pipe handler with an actuating element on a drill rig; translating the at least one engagement element radially inward by applying a mechanical force, via the actuating element, to the at least one engagement element; applying pressure to an actuation volume in the pipe handler in response to the translating the at least one engagement element radially inward; and applying the fluid pressure to the slide in response to the pressure applied to the actuation volume.

Embodiment 77

The method of embodiment 76, further comprising translating the at least one engagement element radially outward by removing the mechanical force from the at least one engagement element; reducing the fluid pressure acting on the slide; and biasing the plurality of grippers radially inward away from the threaded interface in response reducing the fluid pressure acting on the slide.

Embodiment 78

A method of grabbing a tubular comprising inserting a pipe handler into an axial end of a tubular such that a plurality of grippers of the pipe handler are disposed within an internal volume of the tubular; applying a mechanical force to an engagement element of the pipe handler; translating the engagement element radially inward, thereby applying fluid pressure to a slide of the pipe handler; translating the slide in an axial direction toward the plurality of grippers in response to the applied fluid pressure; biasing the plurality of grippers radially outward toward a threaded interface on an inner surface of the tubular in response to the translating of the slide in the axial direction; and contacting the threaded interface of the tubular with the plurality of grippers, thereby grabbing the tubular.

Embodiment 79

The method of embodiment 78, wherein the pipe handler is void of connections to external electrical or hydraulic sources.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

The invention claimed is:

1. A pipe handler comprising:

a body defining an axis;

a slide that selectively translates in a first axial direction that is parallel with the axis and selectively translates in a second axial direction that is opposite the first axial direction; and a plurality of grippers, wherein at least one of the plurality of grippers translates in a first radial direction in response to the translation of the slide in the first axial direction, wherein the at least one of the plurality of grippers translates in a second radial direction in response to the translation of the slide in the second axial direction with the second radial direction being opposite the first radial direction, wherein the at least one of the plurality of grippers is configured to contact a threaded interface of an inner surface of a tubular when the at least one of the plurality of grippers translates in the first radial direction, and wherein each one of the plurality of grippers is rotationally coupled to the body of the pipe handler.

2. The pipe handler of claim 1, wherein each one of the plurality of grippers comprises a polymer surface, and wherein the polymer surface is configured to deform when contacting the threaded interface.

3. The pipe handler of claim 1, further comprising a stop element that is configured to engage an axial end of the tubular, wherein the stop element ensures the plurality of grippers are inserted into the tubular a pre-determined insertion distance when the axial end of the tubular is engaged with the stop element.

4. The pipe handler of claim 3, wherein the stop element comprises a generally planar body, and wherein the stop element is disposed at an axial end of the pipe handler.

5. The pipe handler of claim 4, wherein the stop element defines a central aperture, and wherein the plurality of grippers extend through the central aperture of the stop element.

6. The pipe handler of claim 5, wherein the stop element further comprises at least one cutout extending radially outward from the central aperture, and wherein the at least one cutout is adapted to receive the at least one of the plurality of grippers when the at least one of the plurality of grippers contacts the tubular.

7. The pipe handler of claim 1, wherein the plurality of grippers are equally spaced apart around a circumference of the pipe handler.

8. The pipe handler of claim 1, wherein each one of the plurality of grippers is adapted to pivot about a pivot axis generally perpendicular to the axis of the body.

9. The pipe handler of claim 1, wherein each one of the plurality of grippers comprises:

an arm; and a gripping pad that is rotationally coupled to the arm.

10. The pipe handler of claim 9, wherein the arm comprises a first segment pivotally coupled to the body of the pipe handler, and a second segment coupled to the first segment at an angle and extending into an internal volume of the body.

11. The pipe handler of claim 1, wherein the body comprises a first portion and a second portion, with the second portion being rotatably coupled to the first portion such that the second portion rotates about the axis of the body with respect to the first portion, wherein the second portion being disposed below the first portion, and wherein the plurality of grippers are coupled to the second portion of the body.

12. The pipe handler of claim 11, wherein the slide is at least partially disposed in an internal volume of the body, wherein the slide comprises a head having a tapered surface, and wherein the tapered surface biases the at least one of the plurality of grippers in the first radial direction when the slide is translated in the first axial direction, with the first axial direction being toward the tubular.

13. The pipe handler of claim 12, wherein the pipe handler is transitioned from an unengaged configuration with the tubular to an engaged configuration with the tubular, when the slide is translated in the first axial direction, and wherein the pipe handler is transitioned from the engaged configuration with the tubular to a disengaged configuration with the tubular, when the slide is translated in the second axial direction.

14. A method of grabbing a tubular comprising:

inserting a pipe handler into an axial end of the tubular such that a plurality of grippers of the pipe handler are disposed within an internal volume of the tubular;

applying a mechanical force to at least one engagement element of the pipe handler;

translating the at least one engagement element radially inward in response to applying the mechanical force;

biasing the plurality of grippers radially outward toward a threaded interface on an inner surface of the tubular in response to translating the at least one engagement element radially inward; and contacting the threaded interface of the tubular with the plurality of grippers, thereby grabbing the tubular.

15. The method of claim 14, wherein inserting the pipe handler comprises inserting the pipe handler an insertion distance into the tubular, and wherein the insertion distance is determined by a distance between a stop element of the pipe handler and a bottom end of the plurality of grippers.

16. The method of claim 14, further comprising:

with the tubular grabbed, moving the pipe handler toward a drill string;

after moving the tubular to a desired location, biasing of the plurality of grippers away from the threaded interface; and removing the pipe handler from the tubular.

17. The method of claim 14, wherein biasing the plurality of grippers further comprises:

applying fluid pressure to a slide that is at least partially contained within an internal volume of the pipe handler;

translating the slide in an axial direction toward the plurality of grippers in response to the applying the fluid pressure; and biasing the plurality of grippers radially outward toward a threaded interface in response to the translating of the slide in the axial direction.

18. The method of claim 17, wherein applying the fluid pressure further comprises:

engaging the at least one engagement element of the pipe handler with an actuating element on a drill rig;

translating the at least one engagement element radially inward by applying the mechanical force, via the actuating element, to the at least one engagement element;

applying pressure to an actuation volume in the pipe handler in response to the translating the at least one engagement element radially inward; and applying the fluid pressure to the slide in response to the pressure applied to the actuation volume.

19. The method of claim 18, further comprising:

translating the at least one engagement element radially outward by removing the mechanical force from the at least one engagement element;

reducing the fluid pressure acting on the slide; and biasing the plurality of grippers radially inward away from the threaded interface in response reducing the fluid pressure acting on the slide.

20. A method of grabbing a tubular comprising:

inserting a pipe handler into an axial end of the tubular such that a plurality of grippers of the pipe handler are disposed within an internal volume of the tubular;

applying a mechanical force to an engagement element of the pipe handler;

translating the engagement element radially inward, thereby applying fluid pressure to a slide of the pipe handler;

translating the slide in an axial direction toward the plurality of grippers in response to the applied fluid pressure;

biasing the plurality of grippers radially outward toward a threaded interface on an inner surface of the tubular in response to the translating of the slide in the axial direction; and contacting the threaded interface of the tubular with the plurality of grippers, thereby grabbing the tubular.

21. The method of claim 20, wherein the pipe handler is void of connections to external electrical or hydraulic sources.

* * * * *